United States Patent [19]

Berkes

[11] 4,082,265

[45] Apr. 4, 1978

[54] BICYCLE SUPPORT SYSTEM

[76] Inventor: James R. Berkes, 3572 Metropolitan Pkwy., North Royalton, Ohio 44133

[21] Appl. No.: 590,465

[22] Filed: Jun. 26, 1975

[51] Int. Cl.[2] ..... A63B 69/16

[52] U.S. Cl. ..... 272/73; 280/293

[58] Field of Search ..... 272/73; 211/22, 17; 35/29 R; 280/289, 293–304

[56] References Cited

U.S. PATENT DOCUMENTS

| | | | |
|---|---|---|---|
| 554,754 | 2/1896 | Webber | 272/73 |
| 604,200 | 5/1898 | Vogeler | 272/73 |
| 609,174 | 8/1898 | Thurston | 280/293 |
| 2,450,979 | 10/1948 | Moller | 280/293 |
| 2,534,967 | 12/1950 | Hapman | 272/73 |
| 2,793,877 | 5/1957 | Meier, Jr. | 280/293 |
| 3,352,426 | 11/1967 | Carlson | 272/73 X |

FOREIGN PATENT DOCUMENTS

| | | | |
|---|---|---|---|
| 654,471 | 11/1928 | France | 280/293 |
| 441,841 | 4/1926 | Germany | 280/293 |
| 99,657 | 1/1898 | Germany | 272/73 |
| 8,520 of | 1897 | United Kingdom | 280/293 |
| 11,694 of | 1902 | United Kingdom | 280/293 |
| 17,570 of | 1898 | United Kingdom | 272/73 |

*Primary Examiner*—Richard C. Pinkham
*Assistant Examiner*—T. Brown
*Attorney, Agent, or Firm*—Donnelly, Maky, Renner & Otto

[57] ABSTRACT

A bicycle or other cycle-type vehicle support system for maintaining the bicycle in a generally upright position on a training device or the like while still permitting some movement and leaning of the bicycle to simulate normal riding conditions. The support system includes a pair of elongated legs movably connected to the training device and permitted to undergo some pivoting and/or bending action with respect to the training device, with suitable mechanism being provided for easily coupling the system to the bicycle to effect such support function. The system permits a leaning action of the vehicle, for example, as it is being ridden on the training device while still providing substantial upright support for the vehicle.

10 Claims, 9 Drawing Figures

BICYCLE SUPPORT SYSTEM

BACKGROUND OF THE INVENTION

This invention is directed to a system for supporting a cycle-type vehicle on a training device, and, more particularly, is directed to a system that supports a bicycle in generally upright position on a roller-type training device while still permitting a leaning or floating action of the bicycle as it is ridden on the training device.

There are many occasions when, due to weather conditions and other factors, it becomes desirable or necessary for a cyclist to train and exercise indoors, where space is limited, and a number of training devices are available for that purpose. One form of training device provides a fixed vertical support for the bicycle above the floor. However, this has the objection that it does not even closely simulate actual riding conditions. Some fixed and variable resistance training devices also include the addition of a friction roller to the moving bicycle wheel or the mounting of the bicycle wheel, for example, on a disc-like plate that is rotatable in a horizontal plane. However, they are subject to the same objections, since as before, the training devices maintain the bicycle relatively fixedly supported in a vertical or upright position.

There is another known type of bicycle training device that does provide for simulated riding which includes three cylindrical rollers having parallel rotation axes and mounted so that the rear bicycle wheel rests on two closely positioned rear rollers and the front bicycle wheel rests on a forward roller. The middle and forward rollers are coupled by a belt so that as the cyclist pedals, the rear bicycle wheel effects rotation of the middle and rearmost rollers, and the belt effects rotation of the forward roller, which causes the front bicycle wheel to rotate approximately at the same speed as the rear bicycle wheel. However, it has the disadvantage that, except for the more experienced cyclists, it is very difficult to steer and maintain balance of the bicycle during riding on such a training device.

SUMMARY OF THE INVENTION

With the foregoing in mind, it is a principal object of the present invention to provide a bicycle support system which effectively supports a bicycle in a generally upright position on the mentioned roller-type or other type of training device while still permitting a controlled amount of floating or leaning action of the bicycle for simulated riding. Such a support system facilitates mounting the bicycle by either an experienced or an inexperienced cyclist and also aids a less experienced rider in learning how to use the training device, particularly in regard to balancing and steering.

Another object is to provide such a support system which assists in maintaining vertical guidance and support of the bicycle and rider on a roller-type training device, or the like.

A further object is to provide such a system which facilitates learning how to balance and steer a bicycle on a roller-type training device, or the like.

Still another object is to provide such as system for movably supporting a bicycle on a roller-type training device or the like.

An additional object is to provide such a system which facilitates a cyclist in mounting a bicycle positioned on a roller-type training device, or the like.

These and other objects and advantages of the present invention will become more apparent as the following description proceeds.

To the accomplishment of the foregoing and related ends, the invention, then, comprises the features hereinafter fully described and particularly pointed out in the claims, the following description and the annexed drawings setting forth in detail certain illustrative embodiments of the invention, these being indicative, however, of but a few of the various ways in which the principles of the invention may be employed.

DESCRIPTION OF THE PREFERRED EMBODIMENTS

Figure 1:
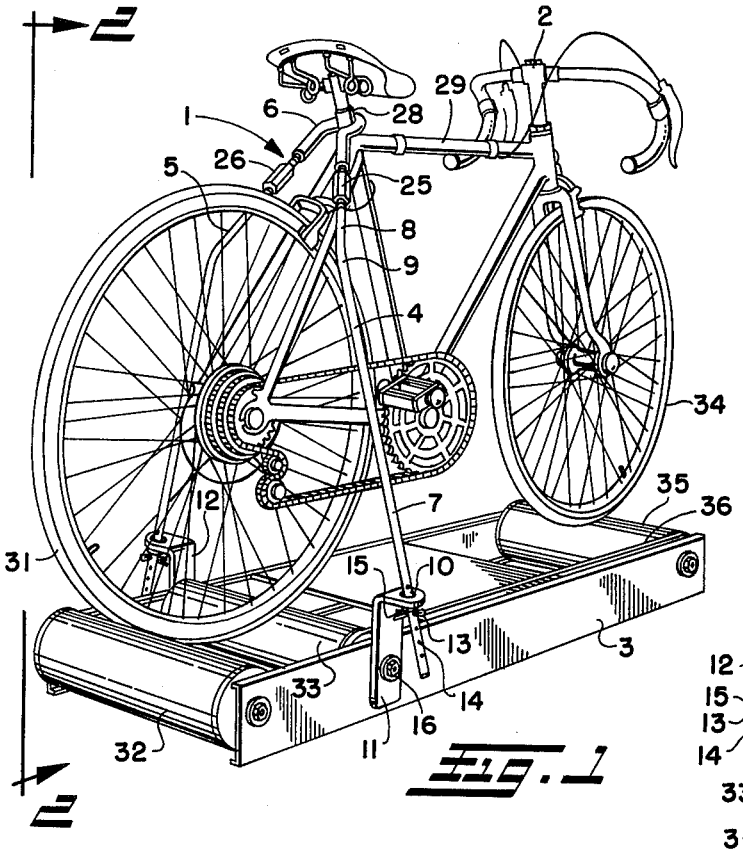
FIG. 1 is a side perspective view of a preferred form of bicycle support system of the instant invention shown coupled to support a bicycle on a roller-type training device.
Figure 2:
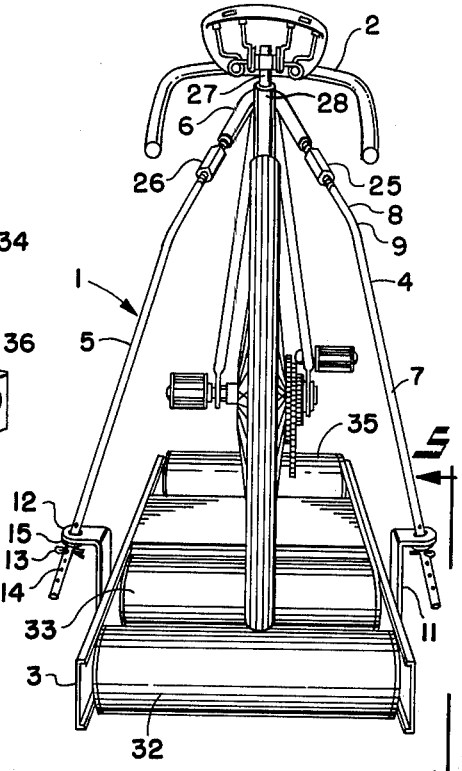
FIG. 2 is a rear perspective view of the bicycle support system, bicycle, and roller-type training device looking in the direction of arrows 2—2 of FIG. 1.

Referring now to the drawings, wherein like reference numerals designate like parts in the several figures, the bicycle support system of the present invention is generally indicated at 1 in FIGS. 1 and 2 and is shown supporting a bicycle 2 in a generally upright position on a conventional roller-type training device 3. The support system 1 includes a pair of generally vertically upstanding elongate legs 4, 5 that are suitably coupled to the bicycle 2 as by means of a generally U-shape coupling member 6. The elongate legs and coupling member are preferably made of steel or other metal, but may also be made of plastic or the like, depending on the desired strength, resiliency, etc. Moreover, while the invention is described herein to support a bicycle-type vehicle, it may also be used with other cycle-type vehicles such as a unicycle.

Figure 5:
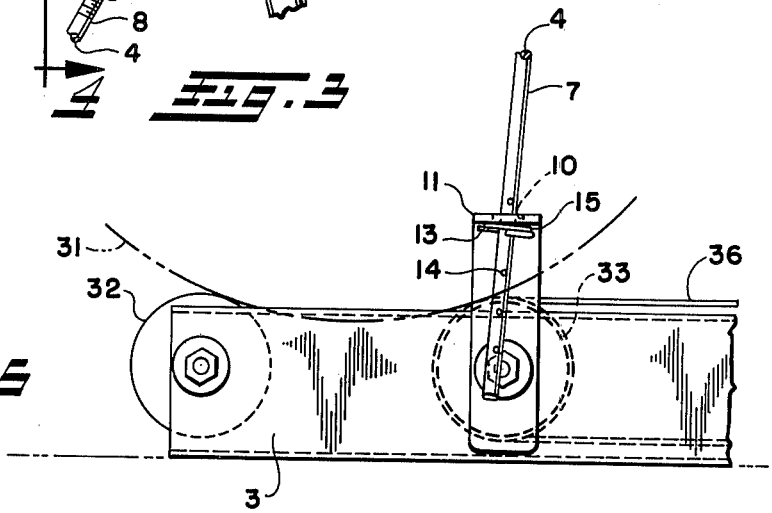
FIG. 5 is an enlarged partial side elevation view of the movable connection for connecting the bicycle support system to a roller-type training device.

Each of the elongate legs 4, 5 is preferably bent to shape and has a generally vertically extending lower leg portion 7 and a more horizontally inclined upper leg portion 8 interconnected by an offset bend 9. The lower leg portions 7 may be movably connected to the training device 3 through a clearance hole 10 in angle mounting brackets 11, 12, as seen clearly in FIGS. 1 and 5. The size of the clearance should be sufficient to permit some degree of pivoting, swiveling, or rotating movement of the respective elongate legs 4, 5 within predetermined limits. Cotter pins or other suitable fasteners 13 coupled to the lower leg portions 7 through small holes 14 hold washers 15 in place to connect the support system 1 to the training device 3. Several spaced-apart holes 14 may be provided for adjustment of the support system to accommodate different size bicycles or to vary the amount of normally permitted leaning action of the bicycle from side to side on the training device, as will be described in more detail below. The mounting brackets 11, 12 may be secured to the device 3, for example, by existing bolts and nuts 16. Of course, such a mounting brackets arrangement for movably connecting the support system 1 to roller-type or other types of training devices is exemplary only, and other connecting arrangements also may be used. Moreover, if desired, the support system 1 may be otherwise supported without connection to the training device, for example, by a connection to the floor.

Figure 4:
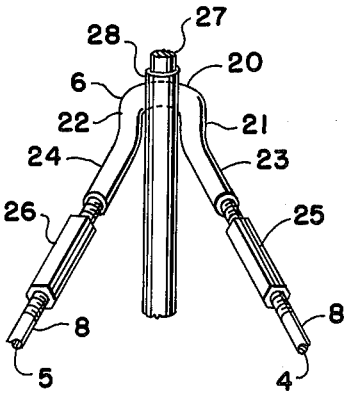
FIG. 4 is a partial rear view of the coupling arrangement of FIG. 3 looking in the direction of arrows 4—4.
Figure 3:
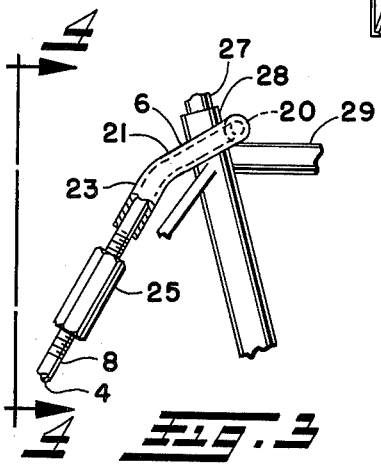
FIG. 3 is an enlarged partial side view of the coupling arrangement for coupling the bicycle support system to the bicycle.

The U-shape portion 20 of the coupling member 6, as seen most clearly in FIGS. 3 and 4, includes a pair of substantially parallel legs 21, 22 and each leg has a downwardly and outwardly extending portion 23, 24, which are preferably but need not necessarily be coupled via turnbuckles 25, 26 to the upper leg portions 8 of the elongate legs 4, 5. A bicycle frame portion, such as the seat tube 27 receiving member 28 loosely fits between the parallel legs 21, 22 to permit limited vertical and lateral pivotal movement of the coupling member relative to the seat tube 27, whereby the bicycle frame portion is permitted some freedom of movement within the coupling member 6.

In the preferred embodiment the U-shape portion 20 of the coupling member 6 may be so located with respect to the frame of the bicycle 2 that it also is capable of resting or bearing down on the bicycle cross bar 29. However, it is to be understood that the bicyle support system 1 may be arranged to couple with other bicycle frame portions as long as there remains some freedom for the bicycle to move or to lean while on the training device so that the cyclist must perform some balancing when riding.

In using the bicycle support system 1 the coupling member 6, for example, may be removed from the turnbuckles 25, 26 to allow the bicycle 2 to be placed on the training device 3 in a position such that the rear bicycle wheel 31 rests on the rear two cylindrical rollers 32, 33 and the front bicycle wheel 34 rests on the forward cylindrical roller 35. Then the coupling member 6 may be slipped about the seat tube receiving member 28, and the turnbuckles 25, 26 may be tightened. By controlled tightening of the turnbuckles, the desired rigidity and/or tension of the bicycle support system may be varied to control the amount of normally permitted leaning action of the bicycle from side to side during riding. The more experienced the rider, the less the turnbuckles need be tightened to maximize the freedom of movement of the bicycle while still providing some support against falling sidewise due to overleaning or loss of balance or both. So assembled, the support system 1 is capable of maintaining the bicycle 2 in a generally upright position with respect to the training device 3 to facilitate mounting and riding of the bicycle on the training device 3 even by an inexperienced cyclist without the need for additional support.

Figure 6:
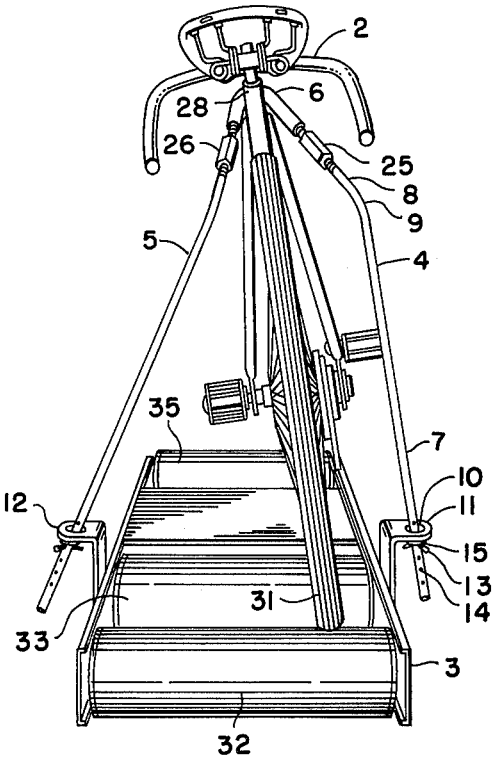
FIG. 6 is a rear perspective view similar to FIG. 2 but showing the bicycle in a leaning or floating position while still being supported by the bicycle support system of the present invention.

As apparent, as the cyclist pedals the bicycle 2, the rear bicycle wheel 31 rotates the rollers 32, 33, which may be connected by a belt 36 to effect rotation of the forward roller 35, thus also to cause the front bicycle wheel 34 to rotate in a clockwise direction, as seen in FIG. 1, simulating actual riding conditions. When ridden, the bicycle has some limited freedom of movement laterally on the rollers. During movement of the bicycle, for example, toward the right side of the training device 3, as shown in FIG. 6, the bicycle and cyclist will tend to lean slightly to the left an amount determined by the bicycle support system 1, depending on the strength or resilience of the elongate legs 4, 5, the rigidity or tensioning thereof by the turnbuckles 25, 26, and the particular holes 14 in which the fasteners 13 are located. During such leaning action, the elongate legs 4, 5 will tend to flex or bend and may pivot or swivel within the clearance holes 10 of the mounting brackets 11, 12 while the coupling member 6 pivots about the seat tube receiving member 28 and/or the cross bar 29 of the bicycle 2 in the manner shown, for example, in FIG. 6. The more the leaning action, the greater the force exerted by the bicycle support system against the bicycle frame tending to maintain the bicycle in upright position. Accordingly, as the cyclist pedals the bicycle and begins to lean as the bicycle is steered toward an edge of the forward roller 35, the bicycle support system 1 of the invention facilitates even a relatively inexperienced cyclist in maintaining the balance necessary to ride the bicycle on the rollers without falling.

Figure 7:
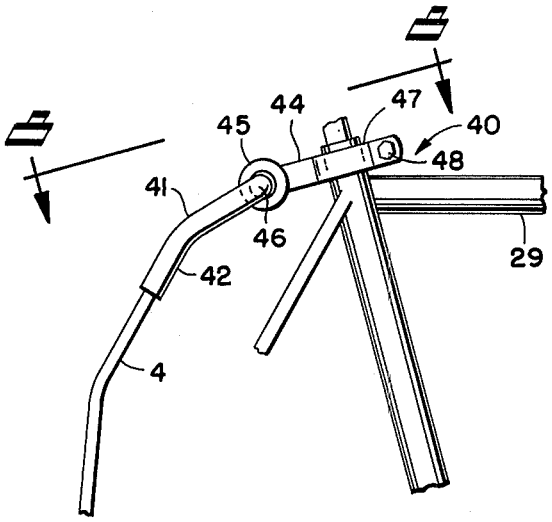
FIG. 7 is an enlarged partial side elevation view of a modified universal coupling arrangement for coupling the bicycle support system to a bicycle.
Figure 8:
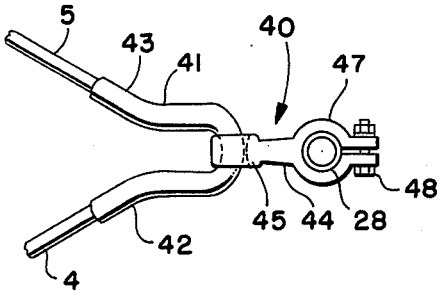
FIG. 8 is a generally top view of the modified universal coupling arrangement looking in the direction of the arrows 8—8 of FIG. 7.

A modified coupling arrangement is generally indicated at 40 in FIGS. 7 and 8 and includes a generally U-shape member 41 similar in form to the U-shape member 6 shown, for example, in FIGS. 3 and 4. The leg portions 42, 43 of such member 41 may be connected directly to the elongate legs 4, 5 of the bicycle support 1, as shown, or they may be coupled utilizing the turnbuckles 25, 26 in the manner previously described. A connecting member 44 has an opening 45 in the outer end thereof for free receipt of the smooth curved portion 46 of the U-shape member 41 permitting limited vertical and lateral pivotal movement of the U-shape member with respect to such connecting member, which may be securely attached by a clamping connection 47 to the bicycle seat tube receiving member 28 or to another appropriate bicycle frame portion by a screw and nut fastener 48. The bicycle support system 1 including the modified coupling arrangement 40 operates generally in the manner described above with reference, for example, to FIGS. 1 through 6; however, as the bicycle begins to lean somewhat from its full upright position, the force tending to retain it still in substantially upright position is applied via the U-shape member 41 and the connecting member 44 to the bicyle frame.

Figure 9:
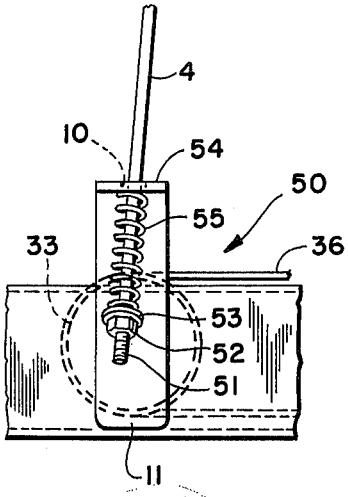
FIG. 9 is an enlarged partial side elevation view of a modified movable connection for connecting the bicycle support system to a roller-type training device.

In FIG. 9 a modified connecting arrangement for the bicycle support system 1 to the training device 3 is generally indicated at 50. The modified connecting arrangement 50 includes the above-described angle mounting brackets 11, 12, only the former being seen in FIG. 9, and each elongate leg, such as the leg 4, is threaded at its bottom end 51 to receive a nut 52 thereon. The nut 52 may be tightened or loosened against a washer 53, which bears against the horizontally extending portion 54 of the angle bracket via a resilient spring or similar device 55. By tightening or loosening nut 52, the tension or rigidity of the bicycle support system 1 can be adjusted to control the amount of normally permissible leaning action before the full effect of the bicycle support system comes into play to support the bicycle in the manner described above. The modified connecting arrangement 50 may be used as a substitute for the turnbuckles 25, 26 but is preferably used in combination therewith to provide a wider range of adjustment, and also to permit a finer adjustment in the tension than would be possible with the modified connecting arrangement 50 by itself.

It should now be clear that the support system of the present invention provides ancillary support to a cycle-type vehicle normally to support same in a generally upright or upstanding position while still permitting some degree of leaning action as the vehicle is operated on a training device that may itself be stationary. The invention facilitates the cyclist both in mounting the vehicle and in maintaining balance during riding of the vehicle.

The embodiments of the invention in which an exclusive property or privilege is claimed are defined as follows:

1. An apparatus for supporting a cycle-type vehicle on a stationary training device comprising elongate legs for supporting such vehicle on such device in a generally upright position for riding, coupling means for coupling such vehicle and such legs, connecting means for movably connecting said legs to such device, said legs, coupling means and connecting means permitting a leaning action of such vehicle with respect to such device while still providing such support, and means for varying the tension in said elongate legs correspondingly to vary the amount of leaning action permitted.

2. An apparatus as set forth in claim 1, wherein said means for varying the tension includes attaching means for attaching said legs to said connecting means.

3. An apparatus as set forth in claim 2, wherein said attaching means comprises a resilient connection between said legs and said connecting means.

4. An apparatus for supporting a cycle-type vehicle on a stationary training device, comprising support means for supporting such vehicle on such device in a generally upright position for riding, said support means including means for permitting a leaning action of such vehicle from side to side with respect to such device while still providing such support, to coupling means for coupling such vehicle and said support means, said support means including a pair of elongate legs, and further comprising connecting means for movably connecting said legs extending outward and downward from said vehicle to said support means and to such training device, said legs being resilient to permit bending to assist in such leaning action of such vehicle.

5. An apparatus for supporting a cycle-type vehicle on a stationary training device, comprising support means for supporting such vehicle on such device in a generally upright position for riding, said support means including means for permitting a leaning action of such vehicle from side to side with respect to such device while still providing such support, and coupling means for coupling such vehicle and said support means, said support means including a pair of elongate legs, and further comprising connecting means for movably connecting said legs to such training device, said coupling means comprising a generally U-shape portion and a pair of generally parallel legs which receive therebetween in relatively confining relation a generally vertically extending part of such vehicle, each of said elongate legs having an offset band defining a generally vertically extending lower leg portion and an inclined upper leg portion, said support means including tension means for adjusting the tension in said support means to vary the magnitude of permissible leaning action in either direction.

6. An apparatus as set forth in claim 5, wherein said tension means includes turnbuckle means for coupling said U-shape portion to said respective upper leg portions.

7. An apparatus for supporting a cycle-type vehicle on a stationary training device, comprising support means for supporting such vehicle on such device in a generally upright position for riding, said support means including means for permitting a leaning action of such vehicle from side to side with respect to such device while still providing such support, and coupling means for coupling such vehicle and said support means, said coupling means comprising a generally U-shape member, and connecting means for securing such U-shape member to such vehicle, said connecting means having a generally horizontal opening therein in which said U-shaped member is received permitting limited vertical and lateral pivotal movement of said U-shape member relative to said connecting means.

8. An apparatus for supporting a cycle-type vehicle on a stationary training device, comprising support means for supporting such vehicle on such device in a generally upright position for riding, said support means including means for permitting a leaning action of such vehicle from side to side with respect to such device while still providing such support, and coupling means for coupling such vehicle and said support means, said support means including a pair of elongate legs, and further comprising connecting means for movably connecting said legs to such training device, said coupling means comprising a generally U-shape portion and a pair of generally parallel legs attached thereto, said U-shaped portion being loosely receive therebetween in relatively confining relation a generally vertially extending part of such vehicle, said coupling means being free to pivot both vertically and laterally relative to such vertically extending vehicle part for aiding the extent of such leaning action.

9. An apparatus as set forth in claim 8, wherein each of said elongate legs has an offset bend defining a generally vertically extending lower leg portion and an inclined upper leg portion.

10. An apparatus as set forth in claim 8, wherein said U-shape portion bears against a generally horizontally extending portion of said vehicle.

* * * * *